US007296966B2

(12) United States Patent
Heyward et al.

(10) Patent No.: US 7,296,966 B2
(45) Date of Patent: Nov. 20, 2007

(54) METHODS AND APPARATUS FOR ASSEMBLING GAS TURBINE ENGINES

(75) Inventors: John Heyward, Loveland, OH (US); Gregg Ford, Cincinnati, OH (US); Christen Vonderau, Rochester, MN (US); Elizabeth Ervin, Springboro, OH (US)

(73) Assignee: General Electric Company, Schenectady, NY (US)

( * ) Notice: Subject to any disclaimer, the term of this patent is extended or adjusted under 35 U.S.C. 154(b) by 85 days.

(21) Appl. No.: 11/016,980

(22) Filed: Dec. 20, 2004

(65) Prior Publication Data

US 2006/0133922 A1 Jun. 22, 2006

(51) Int. Cl.
*F01D 5/14* (2006.01)
*F03B 11/00* (2006.01)

(52) U.S. Cl. ..... 415/115; 415/116

(58) Field of Classification Search ..... 415/115, 415/116; 416/96 R, 96 A, 97 R, 97 A
See application file for complete search history.

(56) References Cited

U.S. PATENT DOCUMENTS 6,354,797 B1 * 3/2002 Heyward et al. ..... 415/191
6,382,908 B1 5/2002 Keith et al.
6,439,837 B1 8/2002 Heyward et al.
6,485,262 B1 11/2002 Heyward et al.
6,527,165 B1 * 3/2003 Budinger et al. ..... 228/226
6,814,538 B2 * 11/2004 Thompson ..... 415/116
6,821,085 B2 * 11/2004 Darkins et al. ..... 415/173.1
2002/0179191 A1 * 12/2002 Fairbourn ..... 148/273
2003/0231955 A1 * 12/2003 Barry et al. ..... 415/115
2005/0002779 A1 * 1/2005 Tanaka ..... 415/173.1
2005/0111965 A1 * 5/2005 Lowe et al. ..... 415/116
2006/0073011 A1 * 4/2006 Lee et al. ..... 415/191

* cited by examiner

*Primary Examiner*—Hoang Nguyen
(74) *Attorney, Agent, or Firm*—William Scott Andes; Armstron Teasdale LLP

(57) ABSTRACT

A method of assembling a gas turbine engine includes coupling at least one turbine nozzle segment within the gas turbine engine, each turbine nozzle segment includes at least one airfoil vane extending between an inner band and an outer band, wherein the airfoil vane includes a leading edge and a trailing edge, and wherein the outer band includes a front face, a rear face, and an inner surface extending therebetween. The method also includes coupling at least one turbine shroud segment downstream from the at least one turbine nozzle segment, wherein each turbine shroud segment includes a front face, a rear face, and an inner surface extending therebetween, and coupling a cooling fluid source to each turbine nozzle segment such that cooling fluid may be channeled to each turbine nozzle inner surface proximate to one of the leading edge and the trailing edge of each airfoil vane, such that cooling fluid channeled to each turbine nozzle outer band rear face is directed towards the front face of at least one turbine shroud segment.

16 Claims, 3 Drawing Sheets

METHODS AND APPARATUS FOR ASSEMBLING GAS TURBINE ENGINES

BACKGROUND OF THE INVENTION

This invention relates generally to gas turbine engines, and more particularly, to methods and apparatus for assembling gas turbine engines.

Known gas turbine engines include a combustor which ignites a fuel-air mixture that is then channeled through a turbine nozzle assembly to power a turbine. Known turbines include a plurality of turbine rotor blades surrounded by a circumferential turbine shroud assembly. The combustion exit gases are channeled through the turbine nozzle assembly and directed towards the rotor blades to cause rotation of the turbine.

At least some known turbine nozzle assemblies include a plurality of circumferentially-oriented nozzle segments. Known turbine nozzle segments are fabricated with at least two circumferentially-spaced hollow airfoil vanes coupled together by integrally-formed inner and outer band platforms. The inner band defines a portion of the radially inner flowpath boundary and the outer band defines a portion of the radially outer flowpath boundary.

As relatively high temperature combustion gases are channeled through the turbine nozzle assembly, over time, the high temperatures may cause the turbine nozzle assembly and the turbine shroud to oxidize. Because of their orientation relative to the gas flow, an inner surface and a rear face of the turbine nozzle assembly outer band are generally most susceptible to oxidation. Moreover, in at least some known turbine nozzle assemblies, oxidation may occur in a discrete arc extending along a throat area defined between adjacent airfoil vanes, wherein combustion gases are channeled through the turbine nozzle assemblies. In at least some other known turbine nozzle assemblies, oxidation may occur along the rear face of the outer band as combustion gas are channeled through a gap defined between the nozzle assembly and the turbine shroud, a condition known as gas path ingestion.

In at least some known gas turbine engines, additional cooling air is channeled to each turbine component to facilitate reducing an operating temperature of the component to yield an acceptable rate of oxidation. However, increasing the flow of cooling air increases the overall operating costs of the engine. Specifically, the increased cooling air may increase the specific fuel consumption of the engine, thus increasing the overall operating costs of the engine.

BRIEF DESCRIPTION OF THE INVENTION

In one aspect, a method of operating a gas turbine engine is provided. The method of assembling a gas turbine engine includes coupling at least one turbine nozzle segment within the gas turbine engine, each turbine nozzle segment includes at least one airfoil vane extending between an inner band and an outer band, wherein the airfoil vane includes a leading edge and a trailing edge, and wherein the outer band includes a front face, a rear face, and an inner surface extending therebetween. The method also includes coupling at least one turbine shroud segment downstream from the at least one turbine nozzle segment, wherein each turbine shroud segment includes a front face, a rear face, and an inner surface extending therebetween, and coupling a cooling fluid source to each turbine nozzle segment such that cooling fluid may be channeled to each turbine nozzle inner surface proximate to one of the leading edge and the trailing edge of each airfoil vane, such that cooling fluid channeled to each turbine nozzle outer band rear face is directed towards the front face of at least one turbine shroud segment.

In another aspect, a nozzle assembly is provided including an inner band, and an outer band including a front face, a rear face, and an inner surface extending therebetween. The outer band rear face includes a plurality of cooling holes configured to direct cooling fluid onto at least one turbine shroud. The inner surface includes a plurality of cooling holes configured to facilitate cooling the inner surface. The nozzle assembly also includes at least one airfoil vane extending between the inner band and the outer band, wherein each of the at least one airfoil vanes includes a first sidewall and a second sidewall connected at a leading edge and a trailing edge.

In a further aspect, a gas turbine engine is provided including a nozzle assembly including an inner band, an outer band, and at least one airfoil vane extending between the inner band and the outer band. Each of the at least one airfoil vane includes a first sidewall and a second sidewall connected at a leading edge and a trailing edge. The outer band includes a front face, a rear face, and an inner surface extending therebetween, and the outer band rear face includes a plurality of cooling holes configured to direct cooling fluid onto at least one turbine shroud. The inner surface includes a plurality of cooling holes configured to facilitate cooling the inner surface.

DETAILED DESCRIPTION OF THE INVENTION

Figure 1:
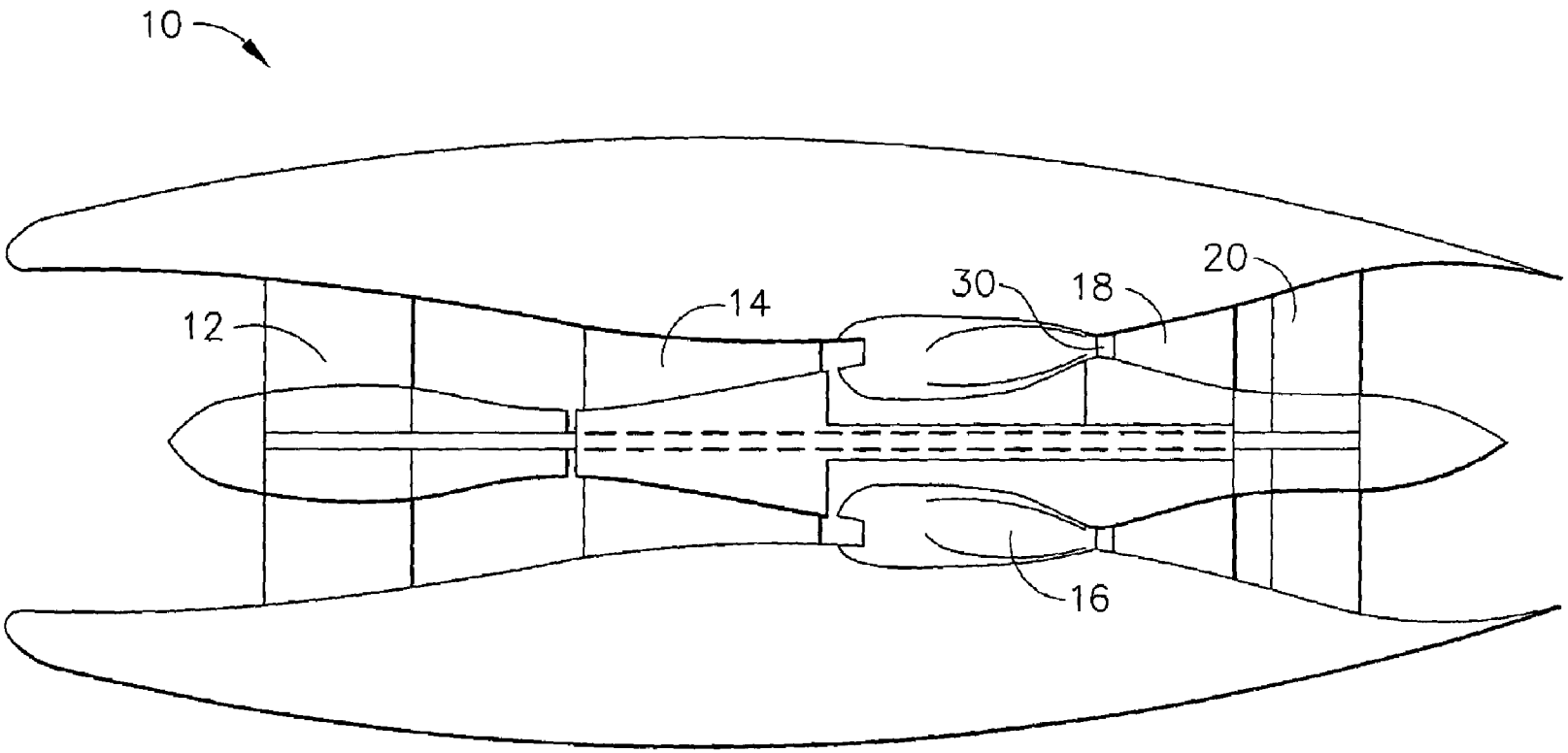
FIG. 1 is a schematic illustration of an exemplary gas turbine engine.

FIG. 1 is a schematic illustration of a gas turbine engine 10 including a low pressure compressor 12, a high pressure compressor 14, and a combustor 16. Engine 10 also includes a high pressure turbine 18 and a low pressure turbine 20.

In operation, air flows through low pressure compressor 12 and compressed air is supplied from low pressure compressor 12 to high pressure compressor 14. The combustion exit gases are delivered from combustor 16 to a turbine nozzle assembly 30. Airflow (not shown in FIG. 1) from combustor 16 drives turbines 18 and 20. In one embodiment, gas turbine engine 10 is a CFM engine available from CFM International. In another embodiment, gas turbine engine 10 is a CF-34 engine available from General Electric Company, Cincinnati, Ohio.

Figure 2:
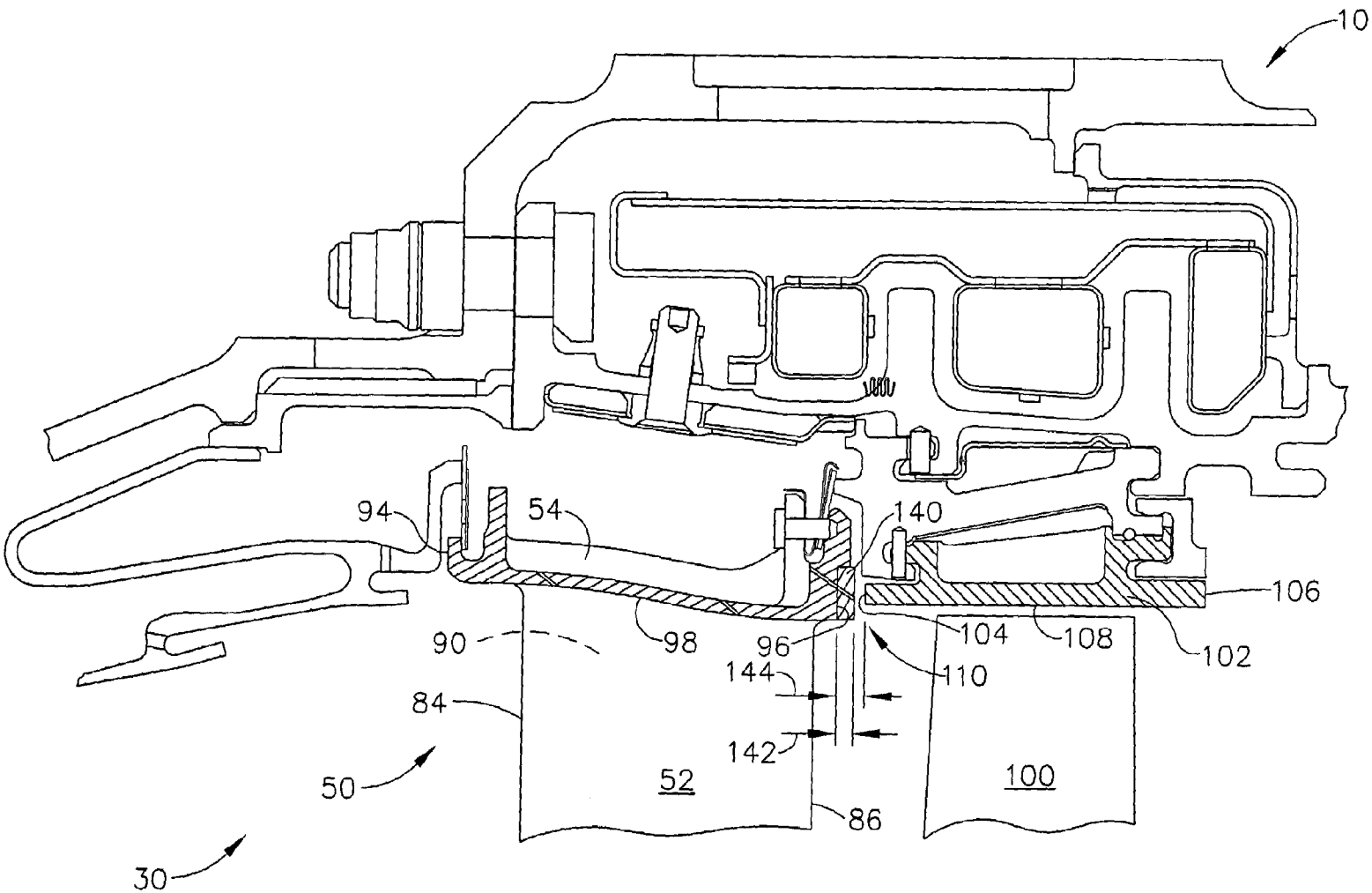
FIG. 2 is a perspective view of an exemplary turbine nozzle segment that may be used with the gas turbine engine shown in FIG. 1.
Figure 3:
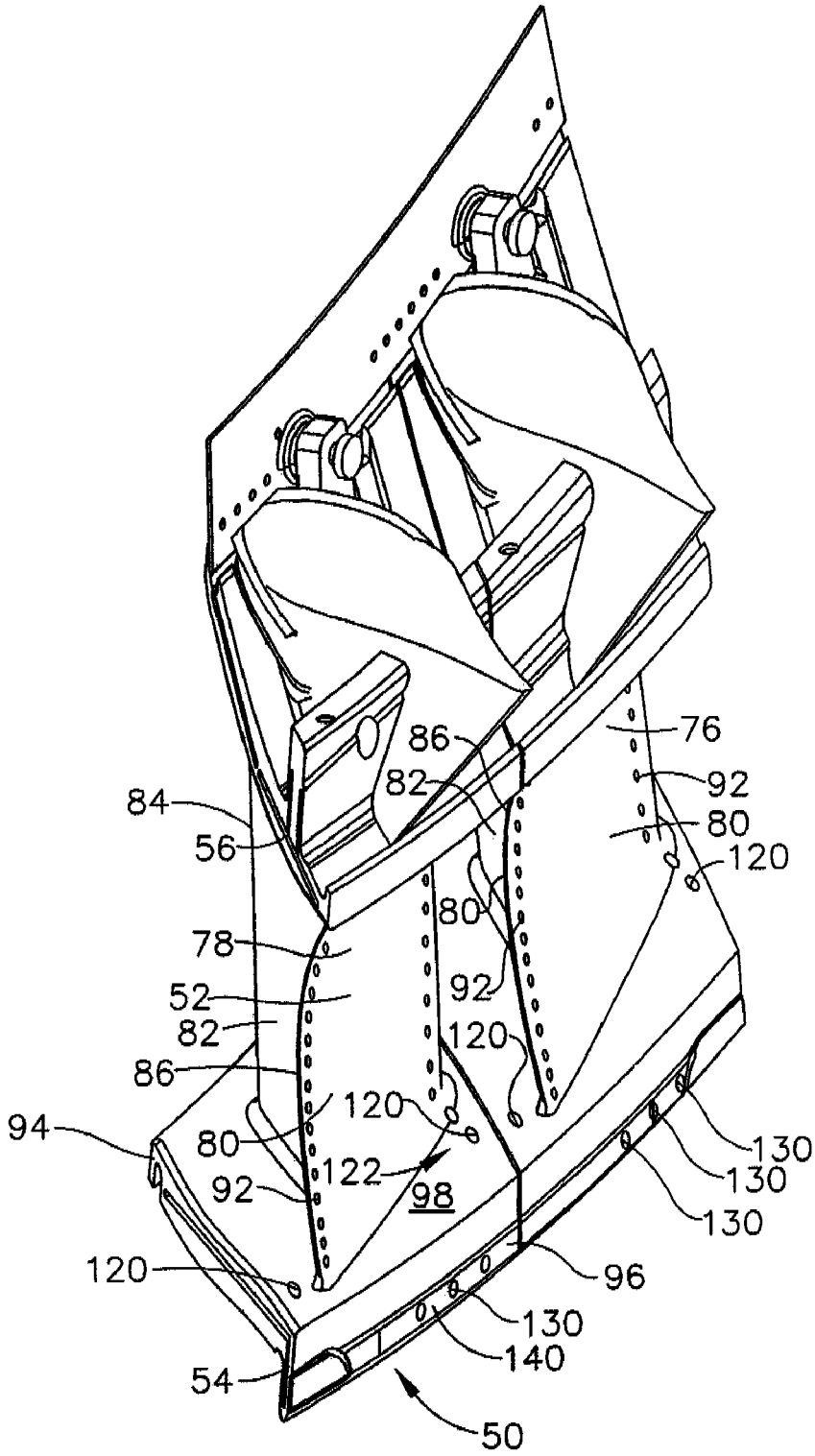
FIG. 3 is a cross-sectional view of the turbine nozzle segment shown in FIG. 2 and coupled with an engine, such as the gas turbine engine shown in FIG. 1.

FIG. 2 is a perspective view of a turbine nozzle segment 50 that may be used with engine 10 (shown in FIG. 1), and FIG. 3 is a cross-sectional view of turbine nozzle segment 50 coupled within engine 10. In the exemplary embodiment, a plurality of turbine nozzle segments 50 are circumferentially coupled together to form turbine nozzle assembly 30 (shown in FIG. 1).

In the exemplary embodiment, nozzle segment 50 includes a plurality of circumferentially-spaced airfoil vanes 52 coupled together by an arcuate radially outer band or platform 54, and an arcuate radially inner band or platform 56. More specifically, in the exemplary embodiment, each band 54 and 56 is integrally-formed with airfoil vanes 52, and each nozzle segment 50 includes two airfoil vanes 52. In such an embodiment, nozzle segment 50 is generally known as a doublet. In an alternative embodiment, nozzle segment 50 includes a single vane 52 and is generally known as a singlet. In yet another alternative embodiment, nozzle segment 50 includes more than two vanes 52.

In the exemplary embodiment, airfoil vanes 52 are substantially identical and each nozzle segment 50 includes a leading airfoil vane 76 and a trailing airfoil vane 78. Each individual vane 52 includes a first sidewall 80 and a second sidewall 82. First sidewall 80 is convex and defines a suction side of each airfoil vane 52, and second sidewall 82 is concave and defines a pressure side of each airfoil vane 52. Sidewalls 80 and 82 are joined at a leading edge 84 and at an axially-spaced trailing edge 86 of each airfoil vane 52. Each airfoil trailing edge 86 is spaced chordwise and downstream from each respective airfoil leading edge 84.

First and second sidewalls 80 and 82, respectively, extend longitudinally, or radially outwardly, in span from radially inner band 56 to radially outer band 54. First and second sidewalls 80 and 82, respectively, define at least one cooling cavity 90 within each airfoil vane 52. More specifically, cavity 90 is bounded by an inner surface (not shown) of each respective airfoil sidewall 80 and 82. Cooling cavity 90 channels cooling fluid through airfoil vane 52 and through airfoil sidewall cooling holes 92.

In the exemplary embodiment, outer band 54 includes a front or upstream face 94, a rear or downstream face 96, and a radially inner surface 98 extending therebetween. Inner surface 98 defines a flow path for combustion gases to flow through nozzle segment 50. In the exemplary embodiment, the combustion gases are channeled through nozzle segments 50 to turbines 18 or 20 (shown in FIG. 1). More specifically, the combustion gases are channeled through turbine nozzle segments 50 to turbine rotor blades 100 which drive turbines 18 or 20.

A turbine shroud assembly 102 extends circumferentially around rotor blades 100 and includes a front or upstream face 104, a rear or downstream face 106, and a radially inner surface 108 extending therebetween. In the exemplary embodiment, a plurality of turbine shroud segments are circumferentially coupled together to form turbine shroud assembly 102. Inner surface 108 defines a flow path for combustion gases to flow through turbines 18 or 20. In the exemplary embodiment, a gap 110 is defined between turbine shroud front face 104 and turbine nozzle rear face 96. Gap 110 facilitates allowing thermal expansion of turbine shroud assembly 102 and/or nozzle segment 50. Additionally, at least a portion of the combustion gases are circulated in and out of gap 110, thus accelerating oxidation of nozzle rear face 96 and/or shroud front face 104, thus reducing an overall performance of engine 10 due to a reduced durability thereof.

A plurality of cooling holes 120 extend across nozzle inner surface 98 to facilitate enhancing film cooling along nozzle inner surface 98. In one embodiment, cooling holes 120 are positioned within a nozzle throat area 122 defined between adjacent airfoil vanes 52 to facilitate reducing oxidation of outer band inner surface 98. Additionally, cooling fluid channeled through cooling holes 120 facilitates cooling other engine components, such as, for example, but not limited to, downstream turbine shroud assembly 102.

In the exemplary embodiment, cooling holes 120 extend arcuately along nozzle inner surface 98 between adjacent airfoil vanes 52. Specifically, cooling holes 120 extend along nozzle inner surface 98 between airfoil vane first sidewall 80, proximate leading edge 84, and an adjacent airfoil vane second sidewall 82, proximate trailing edge 86. In one embodiment, non-chargeable cooling air is supplied to cooling holes 120 such that a specific fuel consumption (SFC) of engine 10 is not increased, thus facilitating reducing operating costs of engine 10. In the exemplary embodiment, three cooling holes 120 are positioned along each nozzle throat area 122. In alternative embodiments, more or less than three cooling holes 120 are positioned along each nozzle throat area 122.

A plurality of cooling holes 130 are spaced across outer band rear face 96 to facilitate providing impingement cooling to turbine shroud front face 104, convection cooling to outer band 54, and/or purge flow to gap 110. In one embodiment, outer band cooling holes 130 facilitate impingement cooling of turbine shroud front face 104, and as such, openings 130 facilitate reducing the amount of cooling fluid used to cool turbine shroud assembly 102. Specifically, in the exemplary embodiment, outer band cooling holes 130 are substantially aligned with throat area 122. In another embodiment, outer band cooling holes 130 are substantially aligned with alternating throat areas 122 of turbine nozzle assembly 22 to facilitate reducing an amount of cooling fluid channeled through cooling holes 130.

In the exemplary embodiment, a plug 140 of material is added to the downstream face of outer band rear face 96. In the exemplary embodiment, plug 140 has a uniform thickness 142 and facilitates reducing a width 144 of gap 110. In one embodiment, gap width 144 is between approximately forty and sixty mils. In another embodiment, gap width 144 is between approximately twenty and forty mils. Gap width 144 varies depending on the temperature of engine components. Accordingly, gap 110 facilitates allowing thermal expansion of the components. In one embodiment, plug thickness 142 is between approximately ten and twenty mils. As such, in the exemplary embodiment, plug thickness 142 enables plug 140 to substantially fill gap 110 while still allowing thermal expansion of nozzle segment 50 and/or turbine shroud assembly 102. By reducing gap width 144, plug 140 facilitates reducing circulation of combustion gas in and out of gap 110. Additionally, by reducing gap width 144, plug 140 facilitates increasing an effective cooling of turbine shroud assembly 102 through cooling fluid discharged from outer band cooling holes 130.

During operation, as combustion gases flow through nozzle segments 50, an operating temperature of nozzle segments 50 is increased. Cooling fluid supplied to cooling holes 120 and/or 130 is channeled through outer band 54 towards inner surface 98 and rear face 96, respectively. Cooling fluid channeled through inner surface holes 120 facilitates film cooling of inner surface 98 within throat area 122. Cooling fluid is also directed downstream of nozzle segment 50 towards turbine shroud assembly 102 to facilitate cooling turbine shroud inner surface 108. Cooling fluid channeled through outer band cooling holes 130 facilitates impingement cooling of turbine shroud front face 104 and film cooling of turbine shroud inner surface 108. Additionally, outer band cooling holes 130 are oriented along outer band 54 such that cooling fluid is directed at the areas of increased operating temperature along turbine shroud assembly 102. Specifically, the cooling fluid is directed to the portions of turbine shroud assembly 102 that are adjacent to combustion gases channeled through nozzle segments 50. Moreover, plug 140 extends into gap 110 to facilitate reducing gap width 144 and to facilitate reducing an amount of cooling fluid used to cool turbine shroud assembly 102.

The above-described turbine nozzle segments include a plurality of cooling holes extending along an inner surface and a rear face of the turbine nozzle outer band. More specifically, the cooling holes extend through the inner surface of the outer band within the throat area of the inner surface of the nozzle, and are substantially aligned with the rear surface. As a result, cooling fluid is supplied to the turbine nozzle segment and turbine shroud in a flow distribution pattern that facilitates distributing cooling fluid the areas of the components directly exposed to the hot combustion gases. Accordingly, the turbine nozzle segment and shroud are operable at a reduced operating temperature, thus facilitating extending the durability and useful life of the turbine nozzle segments, and reduces the operating cost of the engine.

Exemplary embodiments of turbine nozzle segments are described above in detail. The nozzle segments are not limited to the specific embodiments described herein, but rather, components of each turbine nozzle segment may be utilized independently and separately from other components described herein.

While the invention has been described in terms of various specific embodiments, those skilled in the art will recognize that the invention can be practiced with modification within the spirit and scope of the claims.

What is claimed is:

1. A method of assembling a gas turbine engine, said method comprising:

coupling at least one turbine nozzle segment within the gas turbine engine, each turbine nozzle segment includes at least one airfoil vane extending between an inner band and an outer band, wherein the airfoil vane includes a leading edge and a trailing edge, and wherein the outer band includes an outer band front face, an outer band rear face, and an outer band inner surface extending therebetween;

coupling at least one turbine shroud segment downstream from the at least one turbine nozzle segment, wherein each turbine shroud segment includes a front face, a rear face, and an inner surface extending therebetween;

positioning each turbine shroud segment such that a gap is defined between each outer band rear face and the front face of each turbine shroud segment;

coupling a cooling fluid source to each turbine nozzle segment such that cooling fluid is channeled to each turbine nozzle inner surface proximate to one of the leading edge and the trailing edge of each airfoil vane, and defining a plurality of outer band cooling holes within the outer band rear face such that cooling fluid channeled through the outer band rear face cooling holes is directed towards the front face of at least one turbine shroud segment, wherein at least one of the plurality of outer band rear face cooling holes is substantially aligned with a throat area defined between adjacent turbine nozzle airfoils; and applying material to each outer band rear face in a thickness that facilitates reducing an amount of cooling fluid used to cool the nozzle segment, wherein the material includes a hole defined therein that is substantially aligned with an outer band rear face cooling hole.

2. A method in accordance with claim 1 wherein said coupling a cooling fluid source to each turbine nozzle segment further comprises coupling the cooling fluid source to each turbine nozzle segment such that cooling fluid is channeled to the throat area defined between adjacent turbine nozzle airfoils.

3. A method in accordance with claim 1 wherein said coupling a cooling fluid source to each turbine nozzle segment further comprises coupling the cooling fluid source to each turbine nozzle segment such that cooling fluid is channeled to each turbine nozzle outer band to facilitate impingement cooling of the front face of at least one turbine shroud.

4. A method in accordance with claim 1 wherein coupling at least one turbine nozzle segment within the gas turbine engine further comprises positioning cooling holes defined within each turbine nozzle outer band rear face in substantial alignment with a combustion gas flow path channeled through the turbine nozzle segment to facilitate reducing an operating temperature of the turbine shroud during engine operation.

5. A nozzle assembly comprising:

an inner band;

an outer band comprising a front face, a rear face, and an inner surface extending therebetween, said outer band rear face comprising a plurality of cooling holes configured to direct cooling fluid onto at least one turbine shroud segment, said inner surface comprising a plurality of cooling holes configured to facilitate cooling said inner surface, wherein at least one of said plurality of outer band rear face cooling holes is substantially aligned with a throat area defined between adjacent airfoil vanes;

at least one airfoil vane extending between said inner band and said outer band, each said at least one airfoil vane comprising a first sidewall and a second sidewall connected at a leading edge and a trailing edge; and a plug of material coupled to said rear face to facilitate reducing a width of a gap defined between said rear face and a front face of said at least one turbine shroud, wherein said plug of material includes a hole defined therein that is substantially aligned with one of said plurality of outer band rear face cooling holes, said plug of material facilitates reducing an amount of cooling fluid used to cool said nozzle assembly.

6. A nozzle assembly in accordance with claim 5 wherein said inner surface cooling holes are configured to facilitate film cooling of said inner surface.

7. A nozzle assembly in accordance with claim 5 wherein said inner surface cooling holes are positioned proximate the throat area defined between adjacent airfoil vanes.

8. A nozzle assembly in accordance with claim 5 wherein at least one of said inner surface cooling holes extend through said outer band proximate said airfoil leading edge, and wherein at least one of said inner surface cooling holes extends through said outer band proximate said trailing edge.

9. A nozzle assembly in accordance with claim 5 wherein said outer band rear face cooling holes facilitate impingement cooling of a front face of the at least one turbine shroud segment.

10. A nozzle assembly in accordance with claim 5 wherein said outer band rear face cooling holes are configured to direct cooling fluid onto every other turbine shroud segment to facilitate reducing an amount of cooling fluid channeled to said nozzle assembly.

11. A gas turbine engine comprising a nozzle assembly comprising an inner band, an outer band, and at least one airfoil vane extending between said inner band and said outer band, each said at least one airfoil vane comprising a first sidewall and a second sidewall connected at a leading edge and a trailing edge, said outer band comprising a front face, a rear face, and an inner surface extending therebetween, said outer band rear face comprising a plurality of cooling holes configured to direct cooling fluid onto at least one turbine shroud segment, wherein at least one of said plurality of outer band rear face cooling holes is substantially aligned with a throat area defined between adjacent airfoil vanes, said inner surface comprising a plurality of cooling holes configured to facilitate cooling said inner surface, said outer band rear face comprises a plug of material configured to reduce a width of a gap defined between said outer band rear face and a front face of said at least one turbine shroud segment, wherein said plug of material includes a hole defined therein that is substantially aligned with one of said plurality of outer band rear face cooling holes, said plug of material facilitates reducing an amount of cooling fluid used to cool said nozzle assembly.

12. A gas turbine engine in accordance with claim 11 wherein said inner surface cooling holes are configured to facilitate film cooling of said inner surface.

13. A gas turbine engine in accordance with claim 11 wherein said inner surface cooling holes are positioned proximate the throat area defined between adjacent airfoil vanes.

14. A gas turbine engine in accordance with claim 11 wherein at least one of said inner surface cooling holes extend through said outer band proximate said airfoil leading edge, and wherein at least one of said inner surface cooling holes extends through said outer band proximate said trailing edge.

15. A gas turbine engine in accordance with claim 11 wherein said outer band rear face cooling holes facilitate impingement cooling of a front face of the at least one turbine shroud segment.

16. A gas turbine engine in accordance with claim 11 wherein said outer band rear face cooling holes are configured to direct cooling fluid onto every other turbine shroud segment to facilitate reducing an amount of cooling fluid channeled to said nozzle assembly.

* * * * *